US008176602B1

(12) United States Patent
Berich

(10) Patent No.: US 8,176,602 B1
(45) **Date of Patent: *May 15, 2012**

(54) RECLOSABLE STORAGE BAG CLOSURE WITH INTERNAL VALVING

(76) Inventor: Edward Alan Berich, New Braunfels, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/114,719

(22) Filed: May 24, 2011

Related U.S. Application Data

(60) Continuation of application No. 12/247,881, filed on Oct. 8, 2008, now abandoned, which is a division of application No. 11/426,270, filed on Jun. 23, 2006, now Pat. No. 7,437,805.

(51) Int. Cl.
*B65D 33/01* (2006.01)
*B65D 33/16* (2006.01)

(52) U.S. Cl. ..... 24/400; 24/399; 383/45

(58) Field of Classification Search ..... 24/399, 24/400, 585.12, DIG. 40, DIG. 41; 383/59, 383/63, 64, 44, 45, 100, 103
See application file for complete search history.

(56) References Cited

U.S. PATENT DOCUMENTS 2,361,344 A * 10/1944 Yates ..... 426/118
2,541,674 A * 2/1951 Snyder ..... 383/209
3,054,434 A * 9/1962 Ausnit et al. ..... 383/65
3,172,443 A * 3/1965 Ausnit ..... 383/203
3,173,184 A * 3/1965 Ausnit ..... 24/399
3,220,076 A * 11/1965 Ausnit et al. ..... 24/399
3,226,787 A * 1/1966 Ausnit ..... 24/586.1
3,237,844 A * 3/1966 Hughes ..... 383/94
3,302,859 A * 2/1967 Perry ..... 383/103
3,425,469 A * 2/1969 Ausnit ..... 383/65
3,746,215 A * 7/1973 Ausnit et al. ..... 222/92
3,808,649 A * 5/1974 Ausnit ..... 383/63
3,948,705 A * 4/1976 Ausnit ..... 156/73.4
3,959,856 A * 6/1976 Ausnit ..... 24/399
3,987,580 A * 10/1976 Ausnit ..... 446/115
3,991,801 A * 11/1976 Ausnit ..... 383/61.2
4,003,972 A * 1/1977 Herz ..... 264/40.3
4,046,408 A * 9/1977 Ausnit ..... 285/188
4,094,729 A * 6/1978 Boccia ..... 156/515
4,101,355 A * 7/1978 Ausnit ..... 156/66
4,107,870 A * 8/1978 Ausnit ..... 446/116
4,191,230 A * 3/1980 Ausnit ..... 383/61.2
4,196,030 A * 4/1980 Ausnit ..... 156/91
4,199,845 A * 4/1980 Ausnit ..... 24/399
4,235,653 A * 11/1980 Ausnit ..... 156/91
4,249,982 A * 2/1981 Ausnit ..... 156/461
4,252,846 A * 2/1981 Romesberg et al. ..... 428/35.2
4,285,376 A * 8/1981 Ausnit ..... 383/203
4,295,919 A * 10/1981 Sutrina et al. ..... 156/498
4,358,466 A * 11/1982 Stevenson ..... 426/106
4,419,159 A * 12/1983 Herrington ..... 156/66
4,430,070 A * 2/1984 Ausnit ..... 493/215
4,447,935 A * 5/1984 Ausnit ..... 24/456
4,479,244 A * 10/1984 Ausnit ..... 383/63
4,514,962 A * 5/1985 Ausnit ..... 53/457
4,523,918 A * 6/1985 Ausnit ..... 493/198
4,528,224 A * 7/1985 Ausnit ..... 428/35.5
4,532,652 A * 7/1985 Herrington ..... 383/103
4,561,109 A * 12/1985 Herrington ..... 383/65

(Continued)

*Primary Examiner* — Robert J Sandy
(74) *Attorney, Agent, or Firm* — Shiells Law Firm P.C.; Theodore F. Shiells

(57) ABSTRACT

A reclosable fastener having a one-way valve interposed between first and second sets of interlocking members permits fluid flow in one direction through the fastener and blocks fluid flow in an opposite direction through the fastener.

13 Claims, 8 Drawing Sheets

U.S. PATENT DOCUMENTS

| | | | | | |
|---|---|---|---|---|---|
| 4,563,319 | A | * | 1/1986 | Ausnit et al. | 264/146 |
| 4,578,813 | A | * | 3/1986 | Ausnit | 383/65 |
| 4,584,706 | A | * | 4/1986 | Ausnit | 383/37 |
| 4,586,319 | A | * | 5/1986 | Ausnit | 53/468 |
| 4,589,145 | A | * | 5/1986 | Van Erden et al. | 383/5 |
| 4,601,154 | A | * | 7/1986 | Ausnit | 53/119 |
| 4,601,694 | A | * | 7/1986 | Ausnit | 493/381 |
| 4,603,434 | A | * | 7/1986 | Herrington | 383/95 |
| 4,615,045 | A | * | 9/1986 | Siegel | 383/5 |
| 4,625,496 | A | * | 12/1986 | Ausnit | 53/451 |
| 4,629,524 | A | * | 12/1986 | Ausnit | 156/66 |
| 4,637,060 | A | * | 1/1987 | Ausnit | 383/37 |
| 4,651,394 | A | * | 3/1987 | Ausnit et al. | 29/33 K |
| 4,655,862 | A | * | 4/1987 | Christoff et al. | 156/66 |
| 4,657,792 | A | * | 4/1987 | Ausnit | 428/35.5 |
| 4,660,259 | A | * | 4/1987 | Ausnit | 24/585.12 |
| 4,663,915 | A | * | 5/1987 | Van Erden et al. | 53/450 |
| 4,665,552 | A | * | 5/1987 | Lems et al. | 383/37 |
| 4,672,723 | A | * | 6/1987 | Hugues et al. | 24/585.12 |
| 4,682,366 | A | * | 7/1987 | Ausnit et al. | 383/65 |
| 4,683,015 | A | * | 7/1987 | Wagers | 156/66 |
| 4,691,373 | A | * | 9/1987 | Ausnit | 383/63 |
| 4,694,959 | A | * | 9/1987 | Ausnit et al. | 206/390 |
| 4,696,274 | A | * | 9/1987 | Sato | 123/681 |
| 4,698,274 | A | * | 10/1987 | Ausnit et al. | 428/35.5 |
| 4,701,358 | A | * | 10/1987 | Behr et al. | 428/35.5 |
| 4,703,518 | A | * | 10/1987 | Ausnit | 383/63 |
| 4,706,297 | A | * | 11/1987 | Ausnit | 383/63 |
| 4,709,398 | A | * | 11/1987 | Ausnit | 383/63 |
| 4,709,533 | A | * | 12/1987 | Ausnit | 53/451 |
| 4,733,778 | A | * | 3/1988 | Boeckmann et al. | 206/714 |
| 4,736,450 | A | * | 4/1988 | Van Erden et al. | 383/65 |
| 4,736,451 | A | * | 4/1988 | Ausnit | 383/65 |
| 4,741,789 | A | * | 5/1988 | Zieke et al. | 156/66 |
| 4,755,248 | A | * | 7/1988 | Geiger et al. | 156/244.25 |
| 4,764,977 | A | * | 8/1988 | Wagers | 383/63 |
| 4,787,754 | A | * | 11/1988 | Herrington | 383/63 |
| 4,787,880 | A | * | 11/1988 | Ausnit | 493/213 |
| 4,791,710 | A | * | 12/1988 | Nocek et al. | 24/585.12 |
| 4,792,240 | A | * | 12/1988 | Ausnit | 383/63 |
| 4,793,487 | A | * | 12/1988 | Bentsen et al. | 206/451 |
| 4,807,300 | A | * | 2/1989 | Ausnit et al. | 383/65 |
| 4,812,056 | A | * | 3/1989 | Zieke | 383/65 |
| 4,812,074 | A | * | 3/1989 | Ausnit et al. | 493/213 |
| 4,812,192 | A | * | 3/1989 | Woods et al. | 156/251 |
| 4,817,188 | A | * | 3/1989 | Van Erden | 383/63 |
| 4,829,745 | A | * | 5/1989 | Behr et al. | 53/451 |
| 4,832,505 | A | * | 5/1989 | Ausnit et al. | 383/5 |
| 4,837,849 | A | * | 6/1989 | Erickson et al. | 383/104 |
| 4,840,611 | A | * | 6/1989 | Van Erden et al. | 493/213 |
| 4,841,603 | A | * | 6/1989 | Ragni | 24/584.1 |
| 4,848,064 | A | * | 7/1989 | Lems et al. | 53/459 |
| 4,848,928 | A | * | 7/1989 | Ausnit | 383/5 |
| 4,850,178 | A | * | 7/1989 | Ausnit | 53/570 |
| 4,859,083 | A | * | 8/1989 | Nocek et al. | 383/37 |
| 4,876,842 | A | * | 10/1989 | Ausnit | 53/410 |
| 4,878,763 | A | * | 11/1989 | Ausnit | 383/65 |
| 4,890,935 | A | * | 1/1990 | Ausnit et al. | 383/59 |
| 4,892,414 | A | * | 1/1990 | Ausnit | 383/63 |
| 4,894,975 | A | * | 1/1990 | Ausnit | 53/412 |
| 4,896,775 | A | * | 1/1990 | Boeckmann et al. | 206/557 |
| 4,902,374 | A | * | 2/1990 | Smith et al. | 156/515 |
| 4,904,093 | A | * | 2/1990 | Woods et al. | 383/120 |
| 4,929,225 | A | * | 5/1990 | Ausnit et al. | 493/213 |
| 4,949,527 | A | * | 8/1990 | Boeckmann et al. | 53/412 |
| 4,954,124 | A | * | 9/1990 | Erickson et al. | 493/195 |
| 4,964,739 | A | * | 10/1990 | Branson et al. | 383/5 |
| 4,970,845 | A | * | 11/1990 | Ausnit | 53/471 |
| 5,007,142 | A | * | 4/1991 | Herrington | 24/400 |
| 5,007,143 | A | * | 4/1991 | Herrington | 24/400 |
| 5,009,828 | A | * | 4/1991 | McCree | 264/177.1 |
| 5,010,627 | A | * | 4/1991 | Herrington et al. | 24/400 |
| 5,017,021 | A | * | 5/1991 | Simonsen et al. | 383/63 |
| 5,020,194 | A | * | 6/1991 | Herrington et al. | 24/400 |
| 5,022,530 | A | * | 6/1991 | Zieke | 383/204 |
| 5,044,774 | A | * | 9/1991 | Bullard et al. | 383/34.1 |
| 5,063,069 | A | * | 11/1991 | Van Erden et al. | 426/122 |
| 5,063,644 | A | * | 11/1991 | Herrington et al. | 24/400 |
| 5,067,208 | A | * | 11/1991 | Herrington et al. | 24/400 |
| 5,070,583 | A | * | 12/1991 | Herrington | 24/400 |
| 5,070,584 | A | * | 12/1991 | Dais et al. | 24/585.12 |
| 5,088,971 | A | * | 2/1992 | Herrington | 493/203 |
| 5,131,121 | A | * | 7/1992 | Herrington et al. | 24/436 |
| 5,152,613 | A | * | 10/1992 | Herrington, Jr. | 383/63 |
| 5,161,286 | A | * | 11/1992 | Herrington et al. | 24/387 |
| 5,189,764 | A | * | 3/1993 | Herrington et al. | 24/384 |
| 5,259,904 | A | * | 11/1993 | Ausnit | 156/244.15 |
| 5,273,511 | A | * | 12/1993 | Boeckman | 493/195 |
| RE34,554 | E | * | 3/1994 | Ausnit | 383/63 |
| 5,301,395 | A | * | 4/1994 | Richardson et al. | 24/400 |
| 5,363,540 | A | * | 11/1994 | Dais et al. | 24/585.12 |
| 5,382,094 | A | * | 1/1995 | Ausnit | 383/65 |
| RE34,905 | E | * | 4/1995 | Ausnit | 53/412 |
| 5,403,094 | A | * | 4/1995 | Tomic | 383/63 |
| 5,405,478 | A | * | 4/1995 | Richardson et al. | 156/308.4 |
| 5,412,924 | A | * | 5/1995 | Ausnit | 53/412 |
| 5,425,216 | A | * | 6/1995 | Ausnit | 53/410 |
| 5,431,760 | A | * | 7/1995 | Donovan | 156/66 |
| 5,442,837 | A | * | 8/1995 | Morgan | 24/400 |
| 5,448,807 | A | * | 9/1995 | Herrington, Jr. | 24/399 |
| 5,480,030 | A | * | 1/1996 | Sweeney et al. | 206/524.8 |
| 5,482,375 | A | * | 1/1996 | Richardson et al. | 383/64 |
| 5,509,734 | A | * | 4/1996 | Ausnit | 383/63 |
| 5,540,500 | A | * | 7/1996 | Tanaka | 383/43 |
| 5,617,770 | A | * | 4/1997 | May | 83/37 |
| 5,774,955 | A | * | 7/1998 | Borchardt et al. | 24/584.1 |
| 5,829,884 | A | * | 11/1998 | Yeager | 383/45 |
| 5,878,468 | A | * | 3/1999 | Tomic et al. | 24/585.12 |
| 5,901,625 | A | * | 5/1999 | May | 83/338 |
| 5,931,189 | A | * | 8/1999 | Sweeney et al. | 137/512.15 |
| 5,934,806 | A | * | 8/1999 | Tomic et al. | 383/63 |
| 6,000,197 | A | * | 12/1999 | Ausnit | 53/412 |
| 6,009,603 | A | * | 1/2000 | Gallagher | 24/585.12 |
| 6,047,450 | A | * | 4/2000 | Machacek et al. | 24/399 |
| 6,110,090 | A | * | 8/2000 | Ausnit | 493/212 |
| 6,116,781 | A | * | 9/2000 | Skeens | 383/100 |
| 6,131,369 | A | * | 10/2000 | Ausnit | 53/412 |
| 6,131,370 | A | * | 10/2000 | Ausnit | 53/412 |
| 6,138,439 | A | * | 10/2000 | McMahon et al. | 53/412 |
| 6,152,600 | A | * | 11/2000 | Tomic | 383/63 |
| 6,185,796 | B1 | * | 2/2001 | Ausnit | 24/585.1 |
| 6,186,663 | B1 | * | 2/2001 | Ausnit | 383/63 |
| 6,231,236 | B1 | * | 5/2001 | Tilman | 383/61.2 |
| 6,244,021 | B1 | * | 6/2001 | Ausnit et al. | 53/412 |
| 6,299,353 | B1 | * | 10/2001 | Piechocki et al. | 383/63 |
| 6,325,543 | B1 | * | 12/2001 | Ausnit | 383/210.1 |
| 6,354,738 | B1 | * | 3/2002 | Buckman et al. | 383/5 |
| 6,357,915 | B2 | * | 3/2002 | Anderson | 383/100 |
| 6,367,128 | B1 | * | 4/2002 | Galkiewicz et al. | 24/585.1 |
| 6,393,804 | B1 | * | 5/2002 | Ausnit | 53/412 |
| 6,408,872 | B1 | * | 6/2002 | Skeens et al. | 137/512.15 |
| 6,439,771 | B1 | * | 8/2002 | Herrington, Jr. | 383/64 |
| 6,449,924 | B2 | * | 9/2002 | McMahon et al. | 53/412 |
| 6,463,634 | B1 | * | 10/2002 | Naohara et al. | 24/444 |
| 6,474,045 | B2 | * | 11/2002 | McMahon et al. | 53/412 |
| 6,517,660 | B2 | * | 2/2003 | Ausnit | 156/270 |
| 6,526,727 | B2 | * | 3/2003 | McMahon et al. | 53/412 |
| 6,609,827 | B2 | * | 8/2003 | Bois et al. | 383/59 |
| 6,609,828 | B2 | * | 8/2003 | Schneider et al. | 383/204 |
| 6,632,021 | B2 | * | 10/2003 | Bois et al. | 383/59 |
| 6,637,939 | B2 | * | 10/2003 | Huffer | 383/64 |
| 6,692,147 | B2 | * | 2/2004 | Nelson | 383/63 |
| 6,694,704 | B1 | * | 2/2004 | Ausnit | 53/412 |
| 6,783,276 | B2 | * | 8/2004 | Machacek et al. | 383/36 |
| 6,799,890 | B2 | * | 10/2004 | Schneider et al. | 383/210 |
| 6,804,935 | B2 | * | 10/2004 | Schneider et al. | 53/412 |
| 6,805,485 | B2 | * | 10/2004 | Hogan et al. | 383/64 |
| 6,807,794 | B2 | * | 10/2004 | Ausnit et al. | 53/412 |
| 6,810,639 | B1 | * | 11/2004 | McMahon et al. | 53/412 |
| 6,810,641 | B2 | * | 11/2004 | Ausnit | 53/412 |
| 6,820,395 | B2 | * | 11/2004 | Ausnit | 53/412 |
| 6,821,238 | B2 | * | 11/2004 | Crevier et al. | 493/213 |
| 6,854,886 | B2 | * | 2/2005 | Piechocki et al. | 383/59 |
| 6,860,844 | B1 | * | 3/2005 | Ausnit | 493/212 |
| 6,874,298 | B2 | * | 4/2005 | McMahon et al. | 53/412 |
| 6,874,937 | B2 | * | 4/2005 | Ausnit | 383/64 |
| 6,896,409 | B2 | * | 5/2005 | Plourde et al. | 383/64 |

6,904,735 B2 * 6/2005 McMahon et al. ..... 53/412
6,928,791 B2 * 8/2005 Ausnit ..... 53/412
6,941,726 B2 * 9/2005 Ausnit ..... 53/412
6,948,848 B2 * 9/2005 Ausnit ..... 383/64
6,955,465 B2 * 10/2005 Machacek et al. ..... 383/63
6,960,021 B2 * 11/2005 Schneider et al. ..... 383/64
7,260,871 B2 * 8/2007 Borchardt et al. ..... 24/399
7,270,479 B2 * 9/2007 Nelson ..... 383/63
7,322,747 B2 * 1/2008 Borchardt ..... 383/63
2003/0066267 A1 * 4/2003 Nelson ..... 53/412
2005/0141786 A1 * 6/2005 Piechocki et al. ..... 383/59
2006/0179620 A1 * 8/2006 MacHacek ..... 24/400

* cited by examiner

RECLOSABLE STORAGE BAG CLOSURE WITH INTERNAL VALVING

CROSS-REFERENCE TO RELATED APPLICATIONS

This application is a continuation of, and claims the benefit of the filing date of, U.S. patent application Ser. No. 12/247,881 entitled RECLOSABLE STORAGE BAG CLOSURE WITH INTERNAL VALVING, filed Oct. 8, 2008 now abandoned, which is a division of, and claims the benefit of the filing date of, U.S. patent application Ser. No. 11/426,270 entitled RECLOSABLE STORAGE BAG CLOSURE WITH INTERNAL VALVING, filed Jun. 23, 2006, now U.S. Pat. No. 7,437,805.

BACKGROUND OF THE INVENTION

1. Field of the Invention

The invention relates to reclosable storage bags and, more particularly, to reclosable storage bags having a closure having an integral one-way valve.

2. Description of the Related Art

Reclosable plastic storage bags, or zipper-type lock bags, are widely used for storing foods and other items in an airtight enclosure. Generic zipper-type lock bags are available for consumer use in storing leftover foods or other items. Zipper-type lock bags are also made for packaging foods, such as breakfast cereals for example, in printed bags marked for sale to consumers. Some zipper-type lock bags are equipped with a slider feature for ease in opening and closing the reclosable zipper feature. A reclosable zipper feature may include a two-track zipper closure for producing a more positive seal. Some zipper closures extend across the full width of the reclosable storage bag, while other zipper closures extend only part-way across the width of the bag, thereby producing a pour spout when the zipper closure is open.

It is frequently desirable to evacuate excess air or other gases from a reclosable storage bag after the bag has been filled with a food product or some other item. Evacuation of air or other gases can be accomplished by leaving the zipper closure feature part-way open while partially compressing the bag to force air out, and then manually closing the zipper closure feature to prevent air from re-entering the bag.

Some reclosable bags incorporate a separate one-way air valve within the bag's construction for exhausting excess air or other gases once the zipper closure feature is completely closed. The addition of a one-way air valve as a separate feature tends to complicate the design and manufacture of a reclosable storage bag and increases its cost. Moreover, food items that are processed in the bag for preservation require leak-proof fasteners that can be hermetically sealed. Adhesives can be applied to the storage bag package outside the zipper closure feature, and applied as part of the zipper closure or at the packaging machine. However, these methods do not address the problem faced with sealing the closure feature itself at the package ends. A zipper closure that extends only part-way across the bag partly addresses this problem, but reduces the effective opening of the package.

Therefore, there is a need for a reclosable fastener, zipper, or zipper-type lock, feature that addresses at least some of the problems associated with conventional methods and apparatuses for sealing a reclosable plastic storage bag.

SUMMARY OF THE INVENTION

A reclosable fastener having a one-way valve interposed between first and second sets of interlocking members permits fluid flow in one direction through the fastener and blocks fluid flow in an opposite direction through the fastener.

BRIEF DESCRIPTION OF THE DRAWINGS

For a more complete understanding of the present invention and the advantages thereof, reference is now made to the following descriptions taken in conjunction with the accompanying drawings, in which.

DETAILED DESCRIPTION

Figure 1:
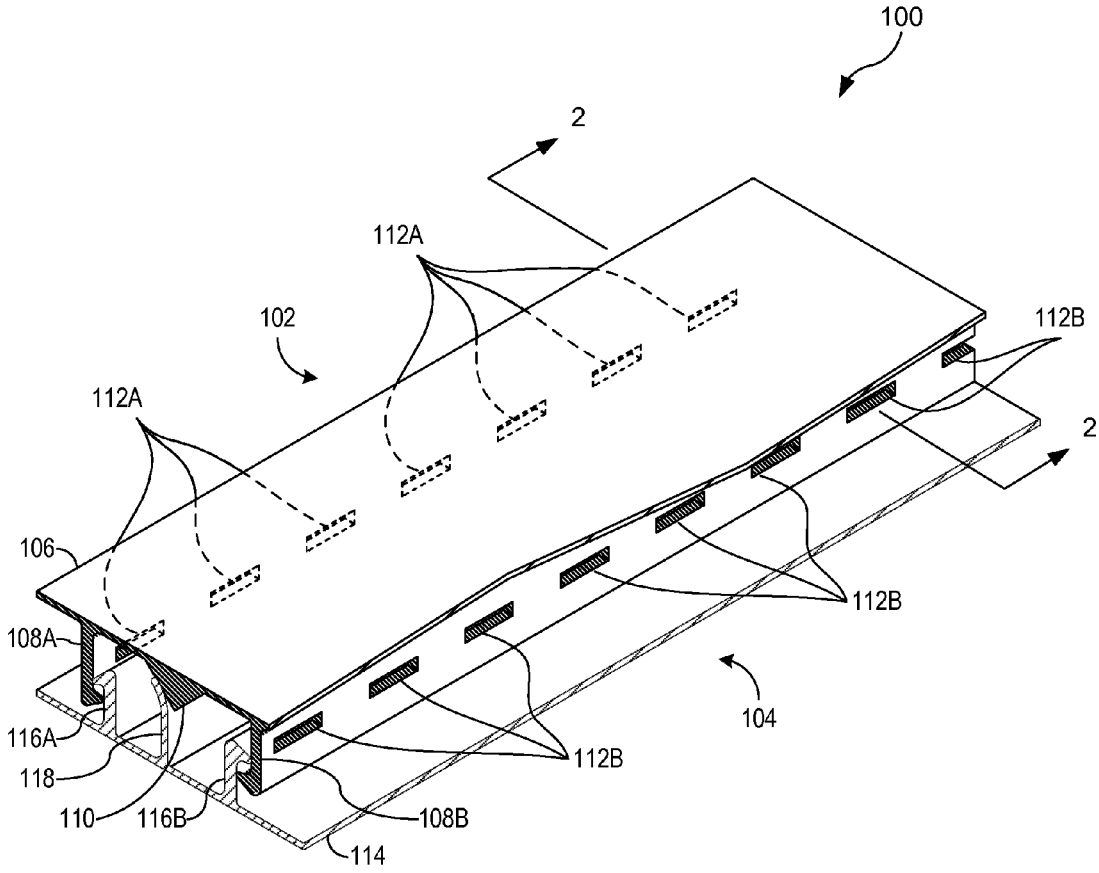
FIG. 1 is a perspective view of a reclosable fastener having an internal valve according to one aspect of the present invention.

In the following discussion, in which the same part of the invention appearing in more than one view is designated by the same reference character, numerous specific details are set forth to provide a thorough understanding of the present invention. However, those skilled in the art will appreciate that the present invention may be practiced without such specific details.

Referring to FIG. 1 of the drawings, the reference numeral 100 generally designates a reclosable fastener having an integral one-way valve according to one embodiment of the present invention. The reclosable fastener 100 has a first set of opposing interlocking members 102 and a second set of opposing interlocking members 104. When engaged, the two sets of opposing interlocking members 102, 104 resist opening unless pulled apart by an opening force. In an embodiment shown, the first set of opposing interlocking members 102 has an elongated base portion or substrate 106, spaced-apart interlocking members 108A, 108B extending therefrom and running the length of the substrate 106, and a wedge-shaped contact surface 110 protruding from and running along the length of the substrate 106 at a position between interlocking members 108A, 108B. In the embodiment shown, spaced-apart interlocking members 108A, 108B have vent openings 112A, 112B, respectively, formed as orifices therein at locations along the length of the interlocking members 108A, 108B. In the embodiment shown, the second set of opposing interlocking members 104 has a base portion or substrate 114, spaced-apart interlocking members 116A, 116B extending therefrom and running the length of the substrate 114, and a flap-like valve stem 118 extending from and running along the length of the substrate 106 at a position between interlocking members 116A, 116B. In the embodiment shown, and as will be explained hereinafter, the reclosable fastener 100 is configured so that the valve stem 118 abuts a surface of contact surface 110 when the reclosable fastener 100 is closed.

Figure 2A:
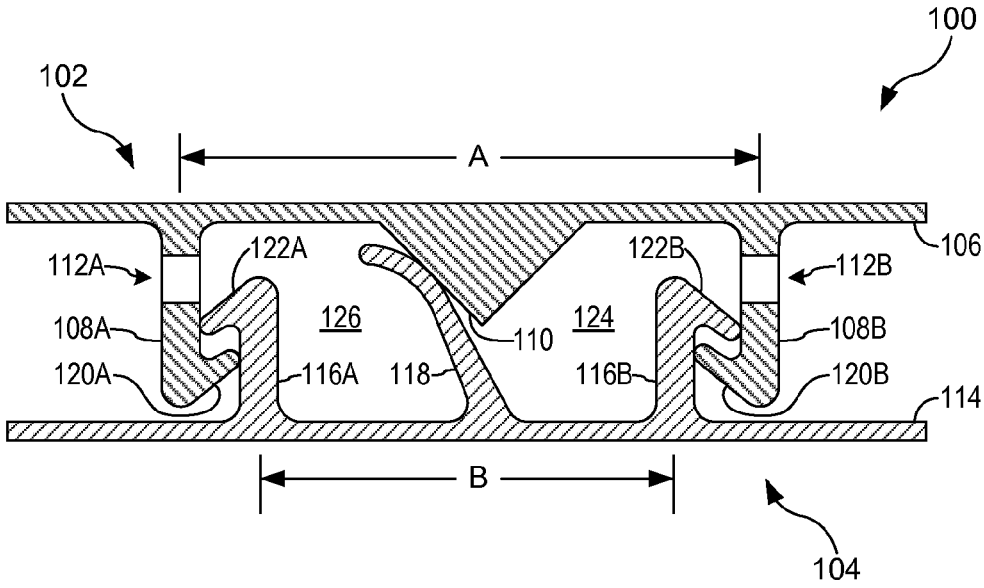
FIGS. 2A-2B are sectional views of the reclosable fastener taken along the lines 2-2 in FIG. 1.

Referring now to FIG. 2A, the reclosable fastener 100 is shown in cross-section taken through a plane intersecting a pair of vent openings 112A, 112B. In the embodiment shown, interlocking members 108A, 108B depend from substrate 106 and terminate in hook-shaped detents 120A, 120B, wherein the hooks 120A, 120B are pointing inwards, towards each other. Cooperatively, interlocking members 116A, 116B arise from substrate 114 and terminate in hook-shaped detents 122A, 122B, wherein the hooks 122A, 122B are pointing outwards, away from each other. The interlocking members 108A, 108B are spaced apart by a first distance A, and interlocking members 116A, 116B are spaced apart by a second distance B, wherein the distance B is less than the distance A such that interlocking members 112A and 116A mate with and interlock with each other, and that interlocking members 112B and 116B mate with and interlock with each other. When engaged, the second set of opposing interlocking members 104 fit between and within the first set of opposing interlocking members 102 so the hook-shaped detent profiles 120A, 120B of the first set 102 mate with and interlock with the hook-shaped detent profiles 122A, 122B of the second set 106. The interlocking members 108A, 108B and 116A, 116B of each set 102, 104 are spaced apart to define one or more cavities 124, 126 between the interlocking members and the substrates. Other shapes of interlocking profiles can also be used in a spaced-apart configuration defining one or more cavities therebetween.

The reclosable fastener 100 can be used to close one end of a flexible storage bag, as will be shown and described in more detail hereinafter. Certain features will now be described with reference to FIGS. 2A-2B, for providing a one-way valve for venting gases through the reclosable fastener 100 when the fastener 100 is closed. As shown in FIG. 2A, the flap-like valve stem 118 abuts contact surface 110 to form a closed valve separating a first cavity 124 from a second cavity 126. The first cavity 124 is defined by contact surface 110, valve stem 118, interlocking members 108B and 116B, a portion of substrate 106 extending between contact surface 110 and interlocking member 108B, and a portion of substrate 114 extending between valve stem 118 and interlocking member 116B. Vent openings 112B formed in and through a wall portion of interlocking member 108B admit gases to and from cavity 124. The second cavity 126 is defined by contact surface 110, valve stem 118, interlocking members 108A and 116A, a portion of substrate 106 extending between contact surface 110 and interlocking member 108A, and a portion of substrate 114 extending between valve stem 118 and interlocking member 116A. Vent openings 112A formed in and through a wall portion of interlocking member 108A admit gases to and from second cavity 126. In the absence of a positive pressure within cavity 124 with respect to cavity 126, valve stem 118 abuts contact surface 110 to separate and seal-off first cavity 124 from second cavity 126.

Figure 2B:
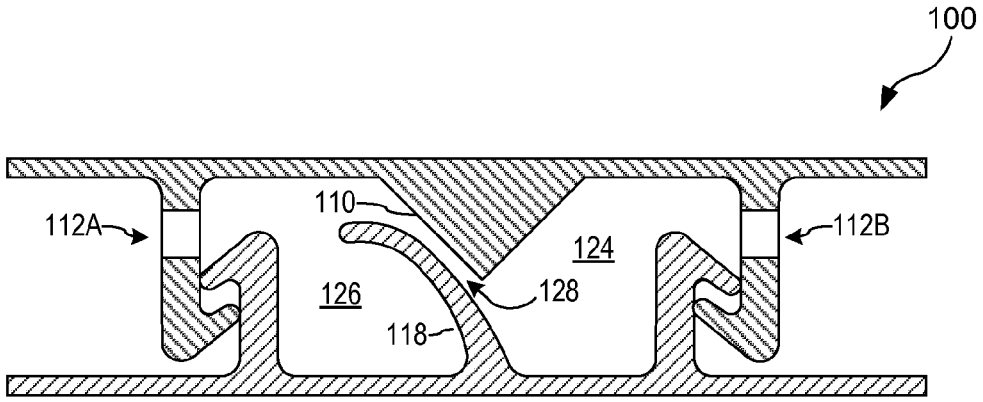

Referring now to FIG. 2B, a positive pressure within first cavity 124 deforms valve stem 118, bending the valve stem 118 away from contact surface 110 and forming a passage 128 through which gases are permitted to flow from first cavity 124 into second cavity 126. When the one-way valve is open, gases are permitted to flow in through vent openings 112B, through first cavity 124, through passage 128, through second cavity 126, and out through vent openings 112A. When the positive pressure appearing in first cavity 124 subsides, the valve stem returns to its original shape and again abuts contact surface 110 to close the one-way valve.

It should be appreciated that although the contact surface 110 is shown as being formed in substrate 106 of the first set of interlocking members 102, and the flap-like valve stem 118 is shown as being formed in the substrate 114 of the second set of interlocking members 104, the positions of the contact surface 110 and valve stem 118 can just as easily be reversed. The contact surface 110 can be formed in a substrate from which interlocking members 116A, 116B extend, and the valve stem 118 can be formed in a substrate from which interlocking members 108A, 108B extend, and the one-way valve formed thereby functions just as well. Moreover, it should be appreciated that vent orifices 112A, 112B can be formed in other locations within the reclosable fastener, as will be shown and described hereinafter.

Figure 3A:
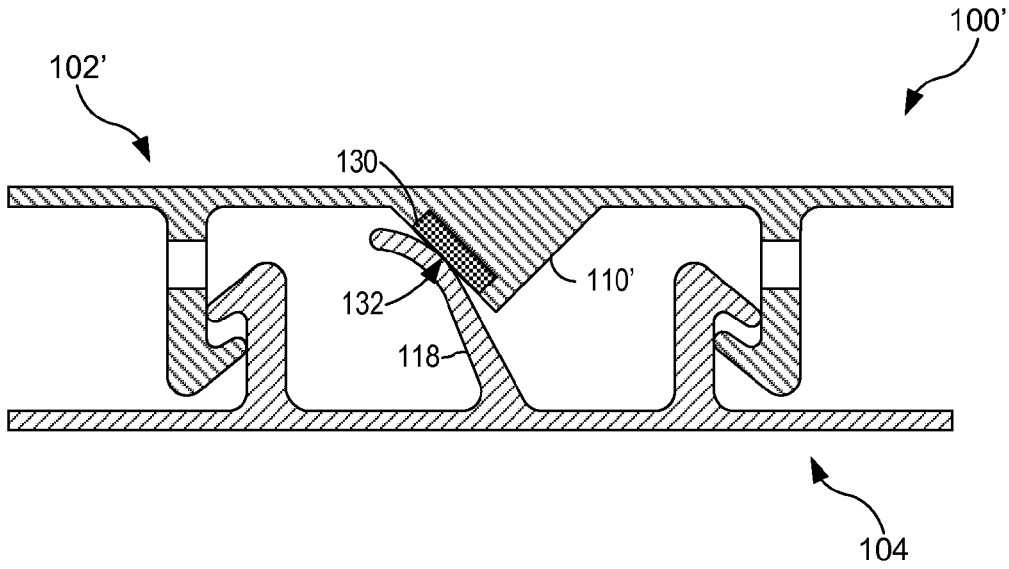
FIGS. 3A-3B are sectional views of the reclosable fastener according to another aspect of the present invention.
Figure 3B:
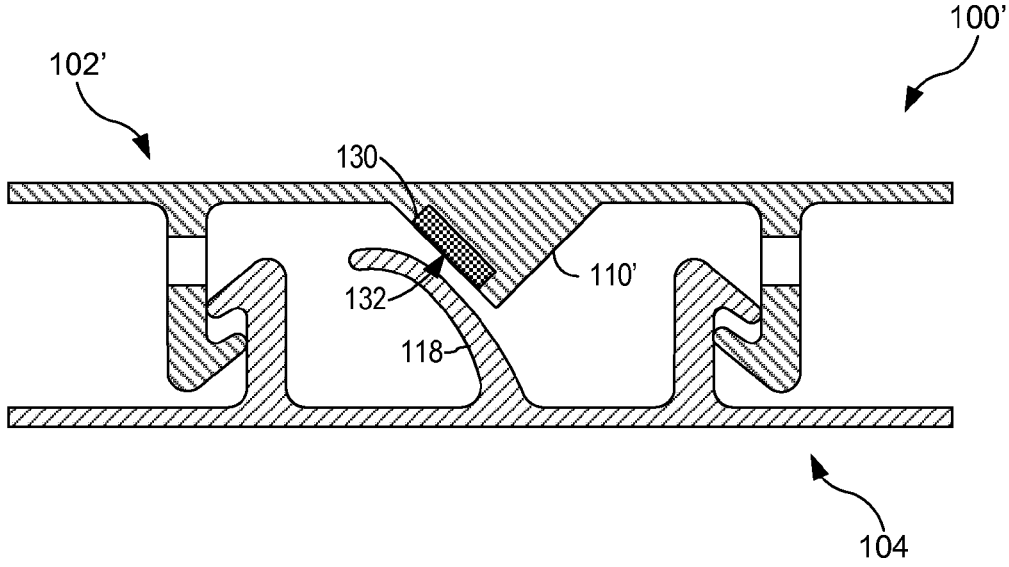

Referring now to FIG. 3A, the reference numeral 100' generally designates a reclosable fastener having an integral one-way valve and an adhesive seal layer according to an embodiment of the present invention. A co-extruded or applied polymer or adhesive seal layer 130 is incorporated into contact surface 110' of first set of opposing interlocking members 102' where valve stem 118 of second set of opposing interlocking members 104 abuts contact surface 110'. The reclosable fastener 100' can be incorporated into a package that is processed with a sufficiently high temperature so that the adhesive seal layer 130 melts and creates a welded bond between the valve stem 118 and the opposed contact point 132. The welded bond at contact point 132 can be broken by opening the reclosable fastener 100' and thereafter internal pressure can bend valve stem 118 away from contact surface 110 as described above, and as shown in FIG. 3B.

Figure 4A:
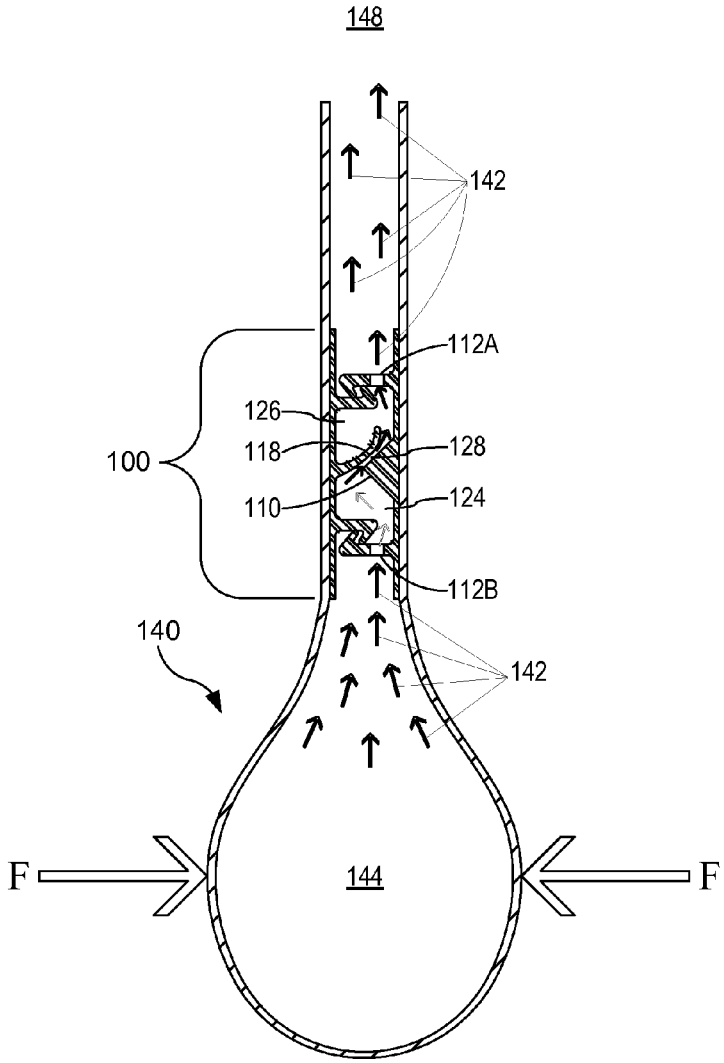
FIGS. 4A-4B are sectional views depicting the reclosable fastener in combination with a flexible bag.
Figure 4B:
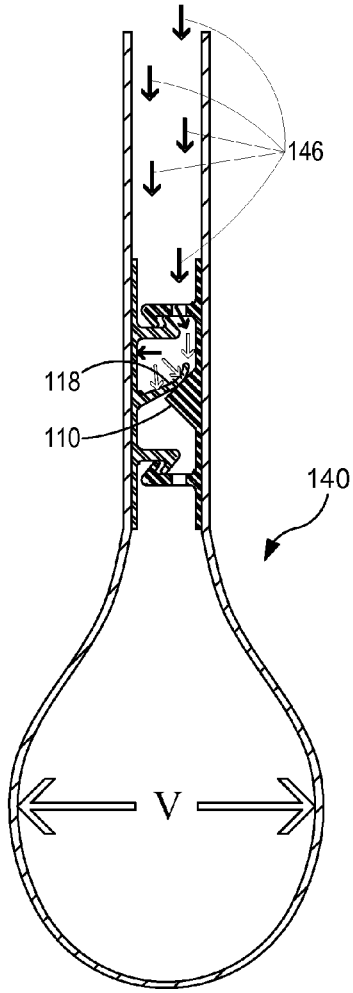

A reclosable fastener 100, or 100', can be incorporated into a package such as a flexible storage bag and used in a known manner to reclose or reseal the bag after opening. FIGS. 4A-4B depict a reclosable fastener 100 included near an opening of a flexible bag 140.

Referring now to FIG. 4A, a force F acting upon bag 140 creates a positive pressure within the bag 140 as sealed by reclosable fastener 100. Gases internal to the bag 140 are urged under pressure to flow towards an available exit which, in this case, is provided by the one-way valve feature of reclosable fastener 100. Arrows 142 indicate the flow of gases from the interior 144 of the bag 140, through vent openings 112B, through first cavity 124, through passage 128 between valve stem 118 and contact surface 110, through second cavity 126, and out through vent openings 112A, thereby venting gases from the interior 144 of the bag 140 to the atmosphere 148. Referring now to FIG. 4B, reversing the pressure creates a partial internal vacuum V within the bag 140, pulling valve stem 118 against contact surface 110 and blocking the flow of gases, indicated by arrows 146, through the reclosable fastener 100.

Figure 5:
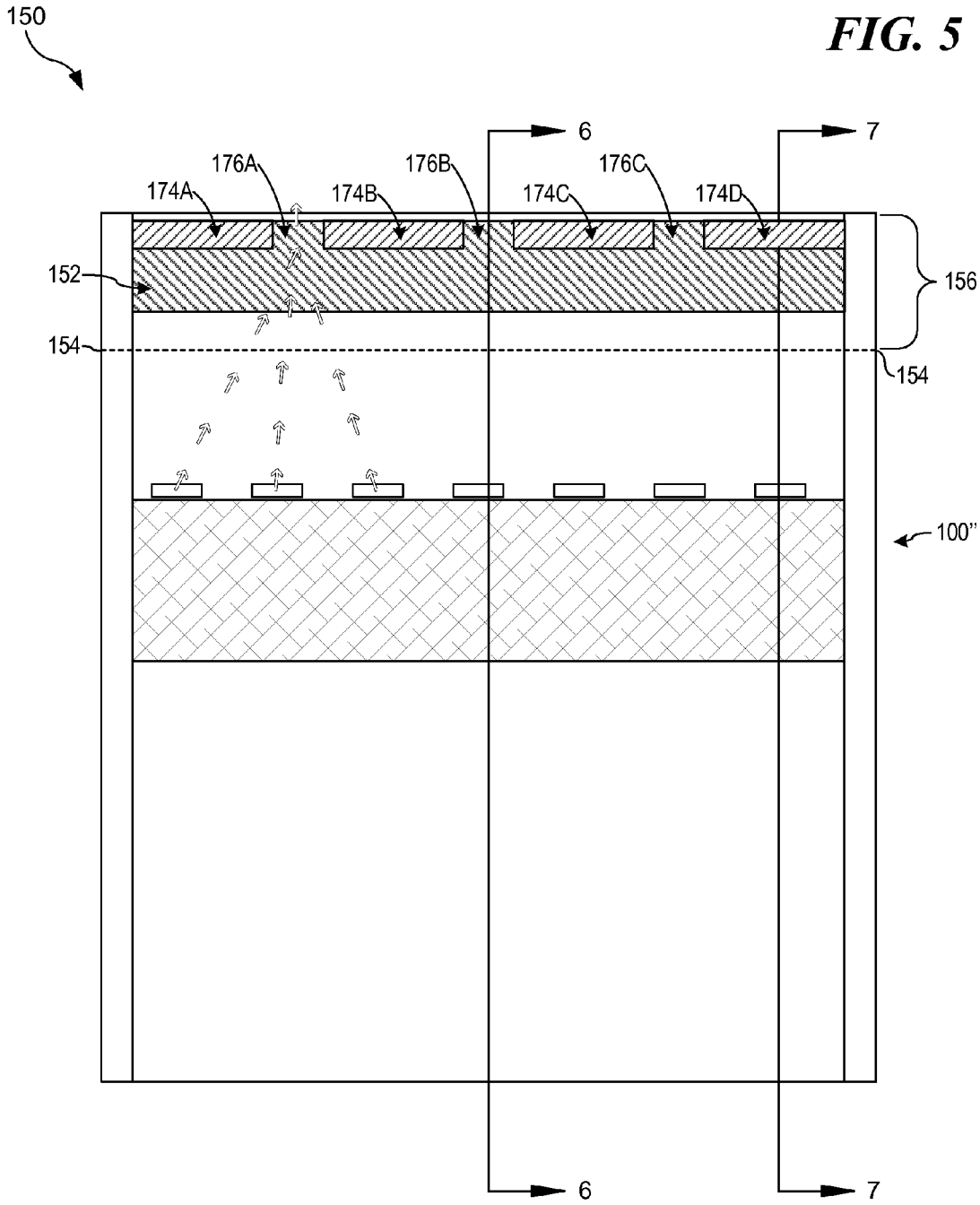
FIG. 5 is an elevation of a flexible bag incorporating a reclosable fastener according to another aspect of the present invention.

Referring now to FIG. 5, a tamper-evident reclosable bag 150 has a substantially permanent seal 152 across the top, where the bag 150 will be opened. A line of perforations 154 provided across the bag and below the substantially permanent seal 152 permit a user to tear off a top portion 156 of the bag 150 to initially gain access to contents of the bag 150. A reclosable fastener 100 incorporated into bag 150, below the top portion 156, can be opened by the user, after tearing off top portion 156 of bag 150, and thereafter be re-closed to close the bag 150 and retain the contents thereof. Further details concerning the construction and operation of tamper-evident reclosable bag 150 will now be explained with reference to sectional views presented in FIGS. 6-7.

Figure 6A:
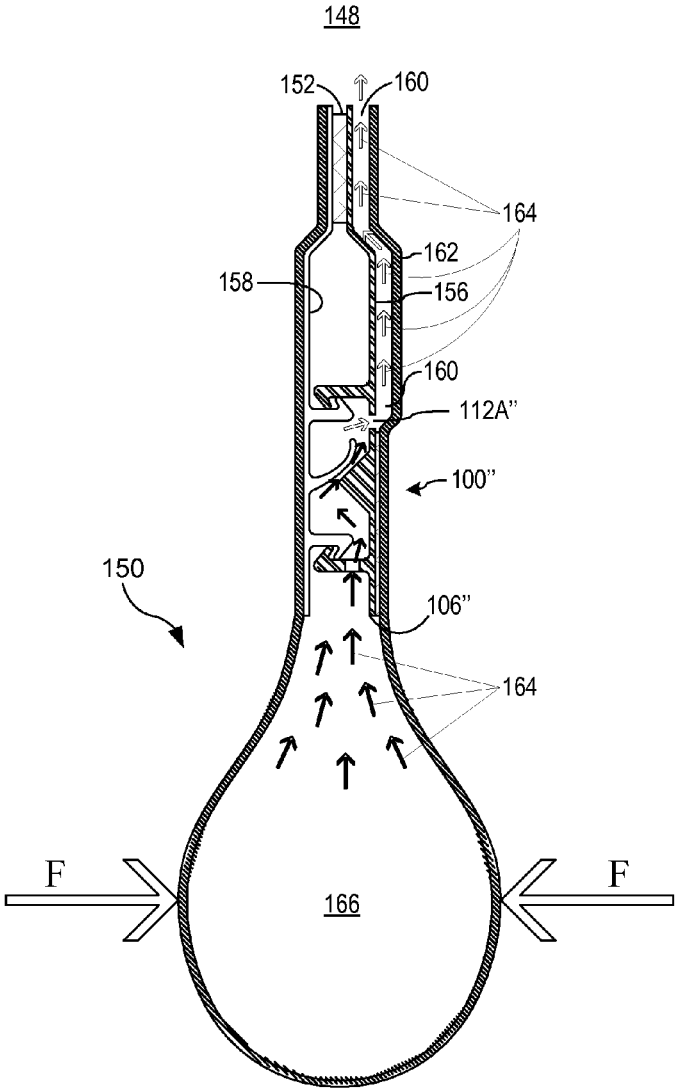
FIGS. 6A-6B are sectional views of the flexible bag taken along the line 6-6 in FIG. 5.
Figure 6B:
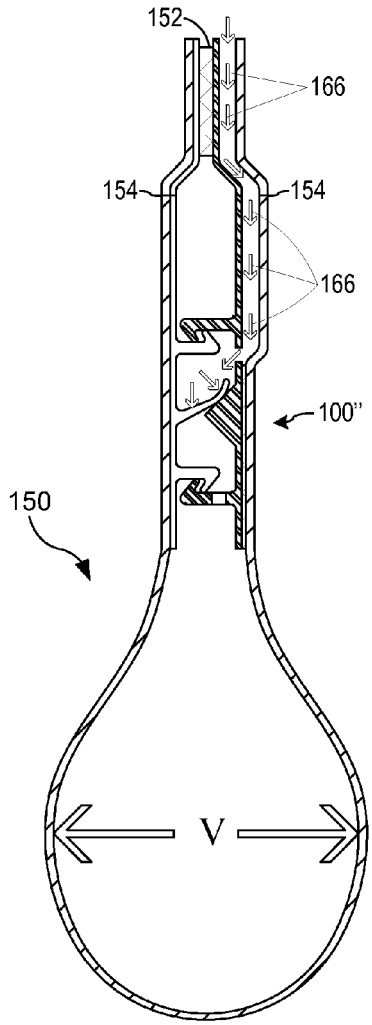

Referring now to FIG. 6A, tamper-evident reclosable bag 150, shown in cross-section taken along the lines 6-6 in FIG. 5, incorporates reclosable fastener 100" having extended flanges 156, 158 extending towards the top of the bag 150. The extended flanges 156, 158 are formed during manufacture of the reclosable fastener 100" by extending substrates 106", 114" in the direction of exit vents 112A". The exit vents 112A" are formed in and through substrate 106" of first set of opposing interlocking members 102". The extended flanges 156, 158 can be grasped by a user and pulled apart to apply an opening force to the reclosable fastener 100". A passageway 160 exists in an unsealed area between the extended flange 156 of substrate 106" and a side wall 162 of reclosable bag 150. A force F acting upon reclosable bag 150 creates a positive pressure within the bag 150 as sealed by reclosable fastener 100". Gases internal to the bag 150 are urged under pressure to flow towards an available exit which, in this case, is provided by the one-way valve feature of reclosable fastener 100". Arrows 164 indicate the flow of gases from an interior 166 of the bag 150, through the reclosable fastener 100" in the manner hereinbefore described, through passageway 160 and to the atmosphere 148. Referring now to FIG. 6B, reversing the pressure creates a partial internal vacuum V within the bag 150, closing the one-way valve in the manner hereinbefore described and blocking the flow of gases, indicated by arrows 166, through the reclosable fastener 100".

Figure 7:
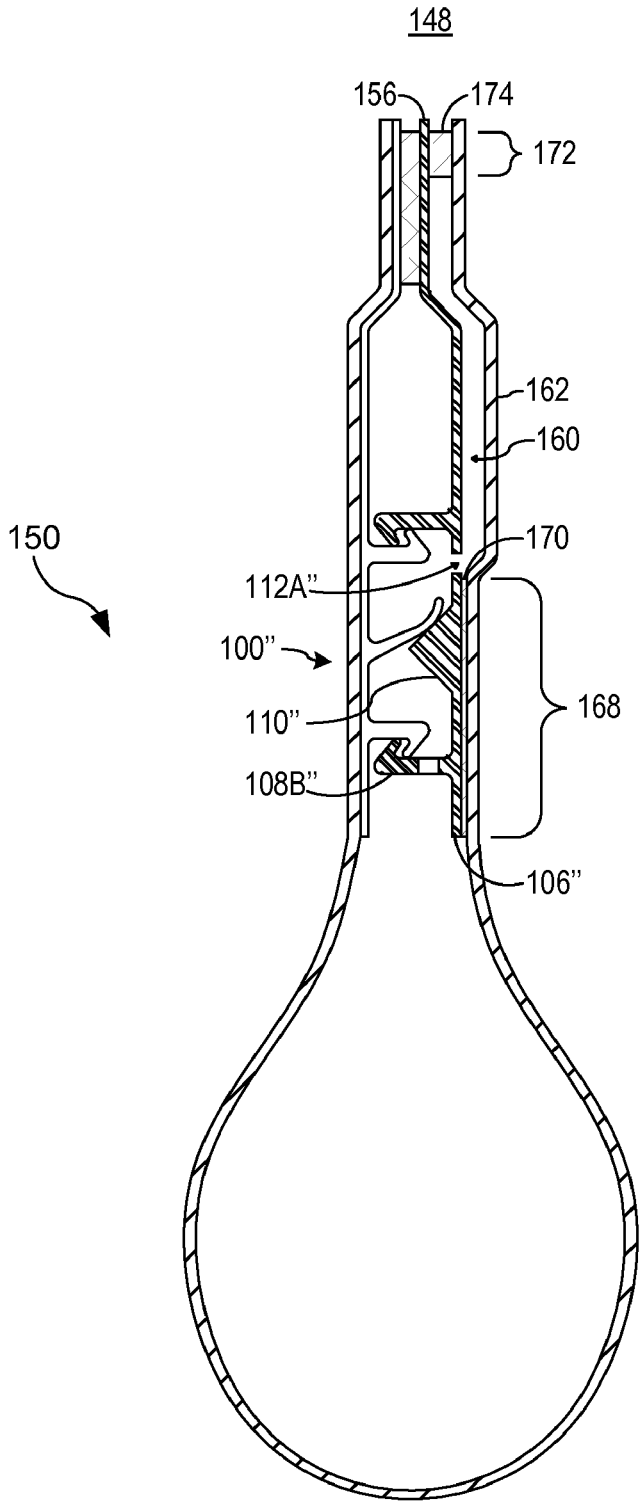
FIG. 7 is a sectional view of the flexible bag taken along the line 7-7 in FIG. 5

Referring now to FIG. 7, the tamper-evident bag 150 is shown in cross-section taken along the line 7-7 in FIG. 5. In the embodiment shown, the side wall 162 of bag 150 is secured to reclosable fastener 100" in at least two places, the first being in a first region 168 adjacent substrate 106" where interlocking member 108B" and contact surface 110" are formed. The side wall 162 can be secured to the substrate 106" utilizing a layer of adhesive material 170 interposed therebetween in the region 168. The side wall 162 can also be secured to extended flange 156 of substrate 106" in a second region 172 at the top thereof, utilizing a substantially permanent seal 174 applied interstitially across the top of the bag 150. The unsealed area between first region 168 and second region 172 forms passageway 160 for conducting gases from exit vents 112A" towards the top of bag 150 and to the atmosphere 148. Referring back to FIG. 5, interstitial seals 174A-D are applied in a segmented fashion across the top of bag 150, leaving gaps 176A-C through which gases can be exhausted from passageway 160 to the atmosphere 148.

The reclosable fasteners 100, 100', 100" disclosed herein, and variations thereon, provide a convenient method of releasing internal pressures from within sealed packaging, while capable of maintaining a hermetic or tamper-evident reclosable package.

With the inclusion of a temperature-sensitive seal layer, predictable release and seal activation can be achieved. The valve stem, when temperature-sealed to the opposing contact point in this manner, creates a tamper-evident or hermetic sealing feature. Modifications to the valve stem can include perforations or scoring of the valve stem 118 and/or adhesive seal layer 130 for controlled destruction of the hermetic seal during initial opening. Equipment for handling fasteners for reclosable packaging can accept the reclosable fastener with internal valving as disclosed herein with minimal or no modifications.

Figure 8A:
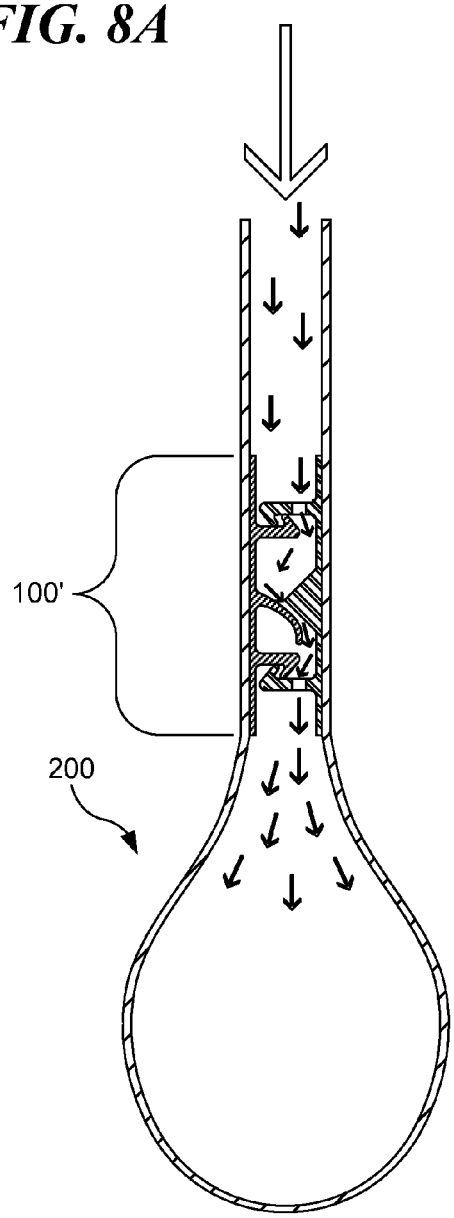
FIGS. 8A-8B are sectional views depicting the reclosable fastener in combination with a flexible bag according to another aspect of the invention.
Figure 8B:
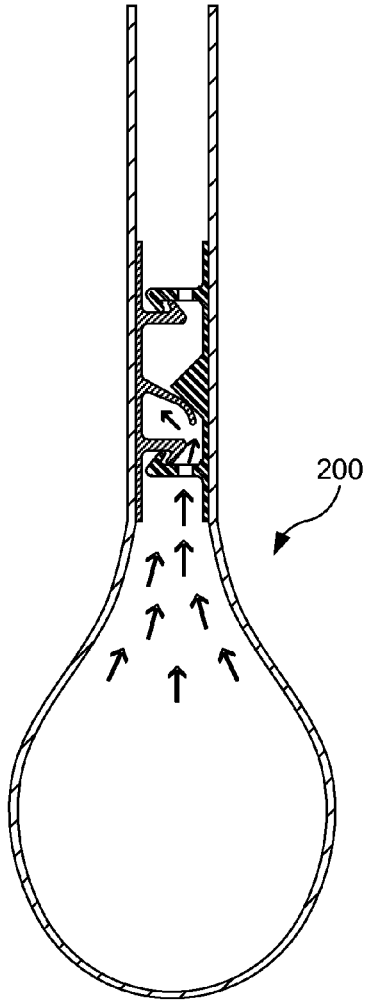

The reclosable fastener can also be applied in an opposite direction to permit the flow of gases into a sealed package while blocking flow out of the sealed package, thereby creating a pillow bag for shipping fragile items, wherein the pillow bag can easily be inflated for use, then deflated for storage by opening the reclosable fastener. Referring now to FIGS. 8A-8B, the reclosable fastener 100' is oriented to permit a flow of gases into an interior of bag 200 and restrict the flow of gases out of the bag 200.

It will further be understood from the foregoing description that various modifications and changes may be made in the preferred embodiment of the present invention without departing from its true spirit. This description is intended for purposes of illustration only and should not be construed in a limiting sense. The scope of this invention should be limited only by the language of the following claims.

The invention claimed is:

1. A reclosable fastener, comprising:

a. a first set of interlocking members;

b. a second set of interlocking members;

c. a one-way valve interposed between the first set of interlocking members and the second set of interlocking members, the valve comprising a resilient flap and an opposed seat, said flap being held against the seat to provide fluid sealing in one direction and permitting fluid flow in the opposite direction when at least one of said first or second set of interlocking members is in the interlocked condition.

2. The reclosable fastener of claim 1 further comprising a first base portion and a second base portion, wherein the first set of interlocking members comprises first and second spaced apart interlocking members extending from the first base portion, and a contact surface extending from the first base portion; and wherein the second set of interlocking members comprises third and fourth spaced apart interlocking members extending from the second base portion, said flap of said valve extending from the second base portion.

3. The reclosable fastener of claim 2, wherein a first cavity is formed between the first base portion and the second base portion, and between the first and third interlocking members and the valve; and wherein a second cavity is formed between the first base portion and the second base portion, and between the second and fourth interlocking members and the valve.

4. The reclosable fastener of claim 1, wherein said seat has an angled surface, and said flap is held against the angled surface of the seat.

5. The reclosable fastener of claim 1, wherein the valve of the reclosable fastener is a one way valve and is oriented to exhaust gases from an interior of the bag and restrict re-entry of gases to the interior of the bag.

6. The reclosable fastener of claim 1, wherein the valve of the reclosable fastener is a one way valve and is oriented to permit a flow of gases into an interior of the bag and restrict the flow of gases out of the bag.

7. A reclosable fastener, comprising:

a. a first set of interlocking members;

b. a second set of interlocking members;

c. a one-way valve interposed between the first set of interlocking members and the second set of interlocking members, the valve comprising a resilient flap and an opposed seat, said flap being held against the seat to provide fluid sealing in one direction and permitting fluid flow in the opposite direction when at least one of said first or second set of interlocking members is in the interlocked condition;

the reclosable fastener further comprising a first base portion and a second base portion, wherein the first set of interlocking members comprises first and second spaced apart interlocking members extending from the first base portion, and a contact surface extending from the first base portion; and wherein the second set of interlocking members comprises third and fourth spaced apart interlocking members extending from the second base portion, said flap of said valve extending from the second base portion;

wherein a first cavity is formed between the first base portion and the second base portion, and between the first and third interlocking members and the valve;

wherein a second cavity is formed between the first base portion and the second base portion, and between the second and fourth interlocking members and the valve; and at least one first orifice formed in a first interlocking member of the first set of interlocking members, and at least one second orifice formed in a second interlocking member of the first set of interlocking members.

8. A reclosable fastener, comprising:

a. a first set of interlocking members;

b. a second set of interlocking members;

c. a one-way valve interposed between the first set of interlocking members and the second set of interlocking members, the valve comprising a resilient flap and an opposed seat, said flap being held against the seat to provide fluid sealing in one direction and permitting fluid flow in the opposite direction when at least one of said first or second set of interlocking members is in the interlocked condition;

the reclosable fastener further comprising a first base portion and a second base portion, wherein the first set of interlocking members comprises first and second spaced apart interlocking members extending from the first base portion, and a contact surface extending from the first base portion; and wherein the second set of interlocking members comprises third and fourth spaced apart interlocking members extending from the second base portion, said flap of said valve extending from the second base portion;

wherein a first cavity is formed between the first base portion and the second base portion, and between the first and third interlocking members and the valve;

wherein a second cavity is formed between the first base portion and the second base portion, and between the second and fourth interlocking members and the valve; and at least one first orifice formed in a first interlocking member of the first set of interlocking members, and at least one second orifice formed in the base portion of the first set of interlocking members.

9. A reclosable fastener, comprising:

a. a first set of interlocking members;

b. a second set of interlocking members;

c. a one-way valve interposed between the first set of interlocking members and the second set of interlocking members, the valve comprising a resilient flap and an opposed seat, said flap beg held against the seat to provide fluid sealing in one direction and permitting fluid flow in the opposite direction when at least one of said first or second set of interlocking members is in the interlocked condition;

the reclosable fastener further comprising a first base portion and a second base portion, wherein the first set of interlocking members comprises first and second spaced apart interlocking members extending from the first base portion, and a contact surface extending from the first base portion; and wherein the second set of interlocking members comprises third and fourth spaced apart interlocking members extending from the second base portion, said flap of said valve extending from the second base portion;

wherein a first cavity is formed between the first base portion and the second base portion, and between the first and third interlocking members and the valve;

wherein a second cavity is formed between the first base portion and the second base portion, and between the second and fourth interlocking members and the valve; and at least one first orifice is formed in the base portion of the first set of interlocking members, and at least one second orifice formed in the base portion of the first set of interlocking members.

10. A reclosable fastener, comprising:

a. a first set of interlocking members;

b. a second set of interlocking members;

c. a one-way valve interposed between the first set of interlocking members and the second set of interlocking members, the valve comprising a resilient flap and an opposed seat, said flap being held against the seat to provide fluid sealing in one direction and permitting fluid flow in the opposite direction when at least one of said first or second set of interlocking members is in the interlocked condition;

the reclosable fastener further comprising a first base portion and a second base portion, wherein the first set of interlocking members comprises first and second spaced apart interlocking members extending from the first base portion, and a contact surface extending from the first base portion; and wherein the second set of interlocking members comprises third and fourth spaced apart interlocking members extending from the second base portion, said flap of said valve extending from the second base portion;

wherein a first cavity is formed between the first base portion and the second base portion, and between the first and third interlocking members and the valve;

wherein a second cavity is formed between the first base portion and the second base portion, and between the second and fourth interlocking members and the valve; and at least one first orifice formed in the base portion of the first set of interlocking members, and at least one second orifice formed in an interlocking member of the first set of interlocking members.

11. A reclosable fastener, comprising:

a. a first set of interlocking members;

b. a second set of interlocking members;

c. a one-way valve interposed between the first set of interlocking members and the second set of interlocking members, the valve comprising a resilient flap and an opposed seat, said flap being held against the seat to provide fluid sealing in one direction and permitting fluid flow in the opposite direction when at least one of said first or second set of interlocking members is in the interlocked condition; and further comprising an adhesive material incorporated into the valve.

12. A reclosable fastener, comprising:

a. a first set of interlocking members;

b. a second set of interlocking members;

c. a one-way valve interposed between the first set of interlocking members and the second set of interlocking members, the valve comprising a resilient flap and an opposed seat, said flap being held against the seat to provide fluid sealing in one direction and permitting fluid flow in the opposite direction when at least one of said first or second set of interlocking members is in the interlocked condition;

the reclosable fastener further comprising a first base portion and a second base portion, wherein the first set of interlocking members comprises first and second spaced apart interlocking members extending from the first base portion, and a contact surface extending from the first base portion; and wherein the second set of interlocking members comprises third and fourth spaced apart interlocking members extending from the second base portion, said flap of said valve extending from the second base portion;

wherein a first cavity is formed between the first base portion and the second base portion, and between the first and third interlocking members and the valve;

wherein a second cavity is formed between the first base portion and the second base portion, and between the second and fourth interlocking members and the valve; and further comprising a first flange extending from the first base portion and a second flange extending from the second base portion.

13. The reclosable fastener of claim 12, further comprising an adhesive material interposed between the first flange and the second flange, wherein the first flange and the second flange are bonded together.

* * * * *